US009363862B1

(12) United States Patent
Xiong et al.

(10) Patent No.: US 9,363,862 B1
(45) Date of Patent: Jun. 7, 2016

(54) AUTOMATIC CURRENT AND REFERENCE GAIN CONTROL FOR WIDE RANGE CURRENT CONTROL

(71) Applicant: Universal Lighting Technologies, Inc., Madison, AL (US)

(72) Inventors: Wei Xiong, Madison, AL (US); Candice Ungacta, Huntsville, AL (US); John J. Dernovsek, Madison, AL (US)

(73) Assignee: Universal Lighting Technologies, Madison, AL (US)

( * ) Notice: Subject to any disclaimer, the term of this patent is extended or adjusted under 35 U.S.C. 154(b) by 237 days.

(21) Appl. No.: 14/096,407

(22) Filed: Dec. 4, 2013

Related U.S. Application Data

(60) Provisional application No. 61/733,466, filed on Dec. 5, 2012.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***G05F 1/10*** | (2006.01) |

(52) U.S. Cl.
CPC . *H05B 37/02* (2013.01); *G05F 1/10* (2013.01)

(58) Field of Classification Search
USPC ..... 315/291–311
See application file for complete search history.

(56) References Cited

U.S. PATENT DOCUMENTS

| | | | | |
|---|---|---|---|---|
| 6,326,740 | B1 * | 12/2001 | Chang | H02M 7/53803 315/194 |
| 2006/0164021 | A1 * | 7/2006 | Ryu | H02M 1/08 315/209 R |
| 2009/0322234 | A1 * | 12/2009 | Chen | H05B 33/0815 315/159 |
| 2010/0327772 | A1 * | 12/2010 | Lee | H05B 33/0818 315/297 |
| 2012/0119669 | A1 * | 5/2012 | Melanson | H05B 33/0815 315/247 |
| 2012/0286681 | A1 * | 11/2012 | Hausman, Jr. | H05B 41/2828 315/200 R |
| 2013/0257311 | A1 * | 10/2013 | Tran | H05B 33/0803 315/279 |
| 2013/0293154 | A1 * | 11/2013 | Kuang | H05B 33/0815 315/307 |
| 2014/0265929 | A1 * | 9/2014 | Gossehelweg | G05F 1/10 315/307 |

* cited by examiner

*Primary Examiner* — Brandon S Cole
(74) *Attorney, Agent, or Firm* — Patterson Intellectual Property Law, P.C.; Mark J. Patterson

(57) ABSTRACT

A constant current source has an increased differential amplifier gain at low output currents and a decreased differential amplifier gain at high output currents. The differential amplifier amplifies a sensed output current of the constant current source. A gain control circuit scales a reference current in conjunction with the gain applied to the sensed output current to maintain stable operation of the constant current source. The constant current source may be used in a driver circuit to provide power to a light source (e.g., an LED light).

13 Claims, 2 Drawing Sheets

AUTOMATIC CURRENT AND REFERENCE GAIN CONTROL FOR WIDE RANGE CURRENT CONTROL

CROSS-REFERENCES TO RELATED APPLICATIONS

This application claims priority to and hereby by reference in its entirety U.S. Provisional Patent Application Ser. No. 61/733,466 entitled "AUTOMATIC CURRENT AND REFERENCE GAIN CONTROL FOR WIDE RANGE CURRENT CONTROL" filed on Dec. 5, 2012.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to circuits and methods that function as constant current sources. More particularly, this invention pertains to methods and circuits for increasing stability of constant current sources in low current operating conditions.

Referring to FIG. 1, a conventional constant current source controller 104 (micro-controller uC) typically needs two signals to maintain a predetermined current level, a current sensing signal (I_sense) and a reference current signal (I_ref_input). A current source tank 102 of the constant current source 100 may be frequency controlled, duty cycle controlled, or other type of current source tank with a control input that is used to adjust the output current of the current source tank 102. A current sensing resistor R_I_sense is in series with a load R_load (e.g., a light source). It is desirable to minimize the resistance value of the current sensing resistor R_I_sense to minimize power consumption by the current sensing resistor R_I_sense. For a wide range of controlled operating output current, the voltage across the current sensing resistor R_I_sense will also be very wide. For example, for an output current range from 1.4 A to 10 mA, the current sensing signal (i.e., voltage) across the current sensing resistor R_I_sense will vary from 0.14V to 0.001V if the resistance of the current sensing resistor R_I_sense is chosen to be 0.1 ohm, a relatively low resistance value to minimize power consumption. Because this voltage signal is relatively small, a current sensing amplifier such as operational amplifier (OPAMP) U1 is used to amplify the signal. A first resistor R1 and a second resistor R2 determine the gain ratio of the OPAMP U1. The gain between the voltage across the current sensing resistor (i.e., I_sense_in) and the current sensing signal I_sense received at the controller 104 is defined in Equation 1.

$$I_{sense} = \frac{R1 + R2}{R2} \cdot I_{sense_in} \qquad \text{EQUATION 1}$$

The controller 104 compares the current reference signal (I_ref_input) and current sensing signal I_sense (i.e., current feedback signal) and maintains the output current level set by current reference signal I_ref_input. The control target is given in Equation 2.

$$I_{ref_input} = I_{sense} = \frac{R1 + R2}{R2} \cdot I_{sense_in} \qquad \text{EQUATION 2}$$

The relationship between the reference current signal I_ref_input and the voltage across the current sensing resistor R_I_sense (i.e., I_sense_in) is shown in Equation 3.

$$\frac{I_{ref_input}}{I_{sense_in}} = \frac{R1 + R2}{R2} \qquad \text{EQUATION 3}$$

The power supply voltage or bias voltage V1 of the controller 104 is typically relatively low (e.g., 3V to 5V). The current sensing signal I_sense received at the controller 104 must be less than the supply voltage V1 of the controller 104 to prevent lockup or instable operation of the controller 104. If the output current range is 100% to 1%, the current sensing signal I_sense received at the controller 104 and used by the controller 104 to control operation for the current source tank 102 would be 5V at full output to 50 mV at minimum output. A 50 mV signal is extremely small for the controller 104 to accurately sense. Circuit ground noise may be greater than 50 mV. This low voltage current feedback signal could be problematic for the controller 104 to accurately determine the output current of the current source tank 102 and may result in stability problems of the circuit.

BRIEF SUMMARY OF THE INVENTION

Aspects of the present invention provide a constant current source having an increased differential amplifier gain at low output currents and a lower differential amplifier gain at high output currents. The differential amplifier amplifies a sensed output current of the constant current source. A current sensing gain adjustment circuit scales a reference current in conjunction with the gain applied to the sensed output current to maintain stable operation of the constant current source. The constant current source may be used in a driver circuit to provide power to a light source (e.g., an LED light).

In one aspect, a constant current driver circuit includes a current source tank circuit, a controller, an output current sensing circuit, and a gain control circuit. The current source tank circuit receives power from a power source and provides an output current to a load as a function of a control signal. The current source tank circuit has a circuit ground. The controller has an output current sensing input, a reference current input, and a controller signal output. The control signal output provides the control signal to the current source tank circuit. The controller adjusts the control signal as a function of a sensed output current received at the output current sensing input and a sensed reference current received at the reference current input. The output current sensing circuit senses the output current provided by the current source tank circuit to the load and provides an amplified current sensing signal to the output current sensing input of the controller. The gain control circuit receives a reference current signal, adjusts a gain of the output current sensing circuit as a function of the received reference current signal, and provides a modified reference current signal to the reference current input of the controller as a function of the received reference current signal.

In another aspect, a light fixture includes a light source, a constant current driver circuit, and a housing. The housing supports the light source and the constant current driver circuit. The light source provides light in response to receiving power. The constant current driver circuit is configured to provide power to the light source. The constant current driver circuit includes a current source tank circuit, a controller, an output current sensing circuit, and a gain control circuit. The current source tank circuit receives power from a power source and provides power to the light source as a function of a control signal. The current source tank circuit has a circuit ground. The controller has an output current sensing input and a control signal output. The control signal output provides the control signal to the current source tank circuit. The controller adjusts the control signal as a function of a sensed output current received at the output current sensing input and a sensed reference current received at the reference current input. The output current sensing circuit senses the output current provided by the current source tank circuit to the light source and provides an amplified current sensing signal to the output current sensing input of the controller. The gain control circuit receives a reference current signal, adjusts a gain of the output current sensing circuit as a function of the received reference current signal, and provides a modified reference current signal to the reference current input of the controller as a function of the received reference current signal.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified.

As used herein, "ballast" and "driver circuit" refer to any circuit for providing power (e.g., current) from a power source to a light source. Additionally, "light source" refers to one or more light emitting devices such as fluorescent lamps, high intensity discharge lamps, incandescent bulbs, and solid state light-emitting elements such as light emitting diodes (LEDs), organic light emitting diodes (OLEDs), and plasmaloids. Further, "connected between" or "connected to" means electrically connected when referring to electrical devices in circuit schematics or diagrams.

Figure 1:
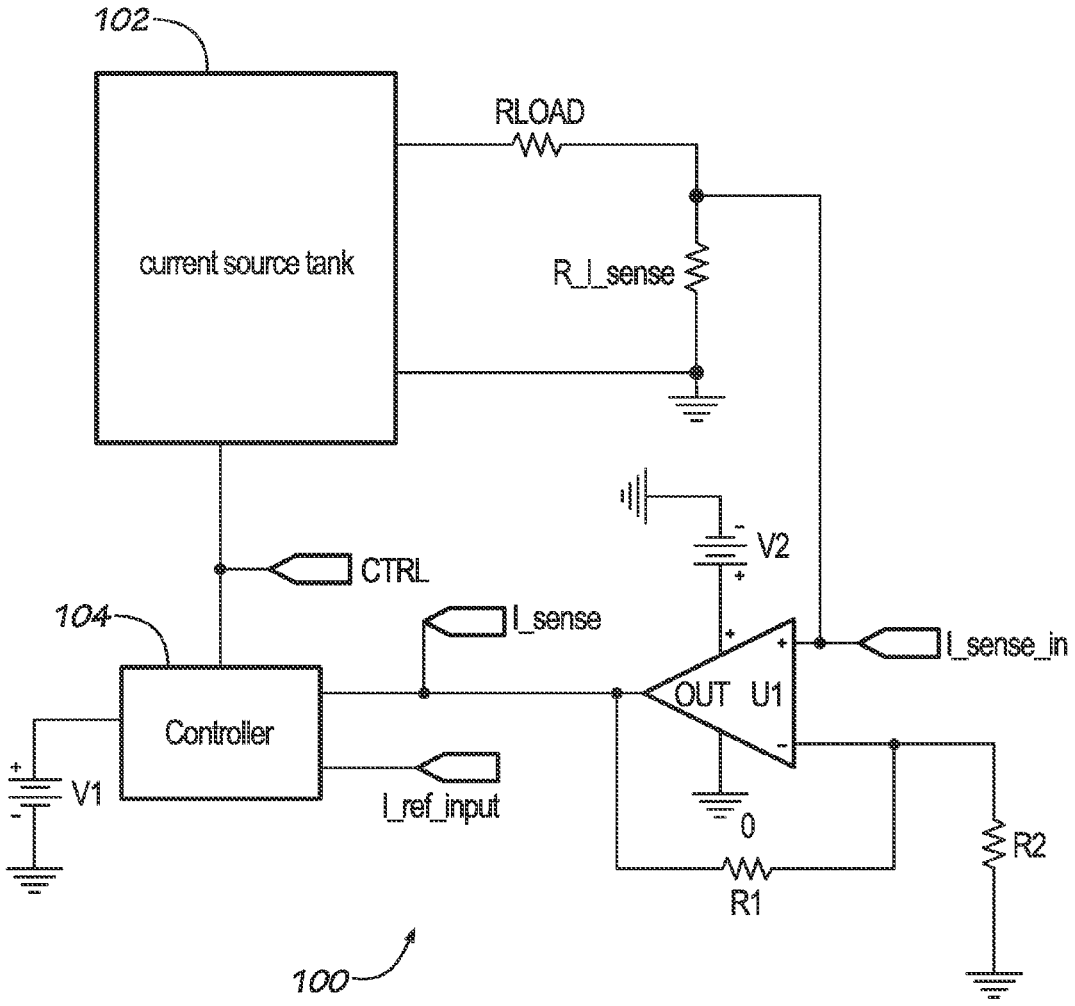
PRIOR ART FIG. 1
FIG. 1 is a partial schematic diagram of a prior art constant current driver circuit.
Figure 2:
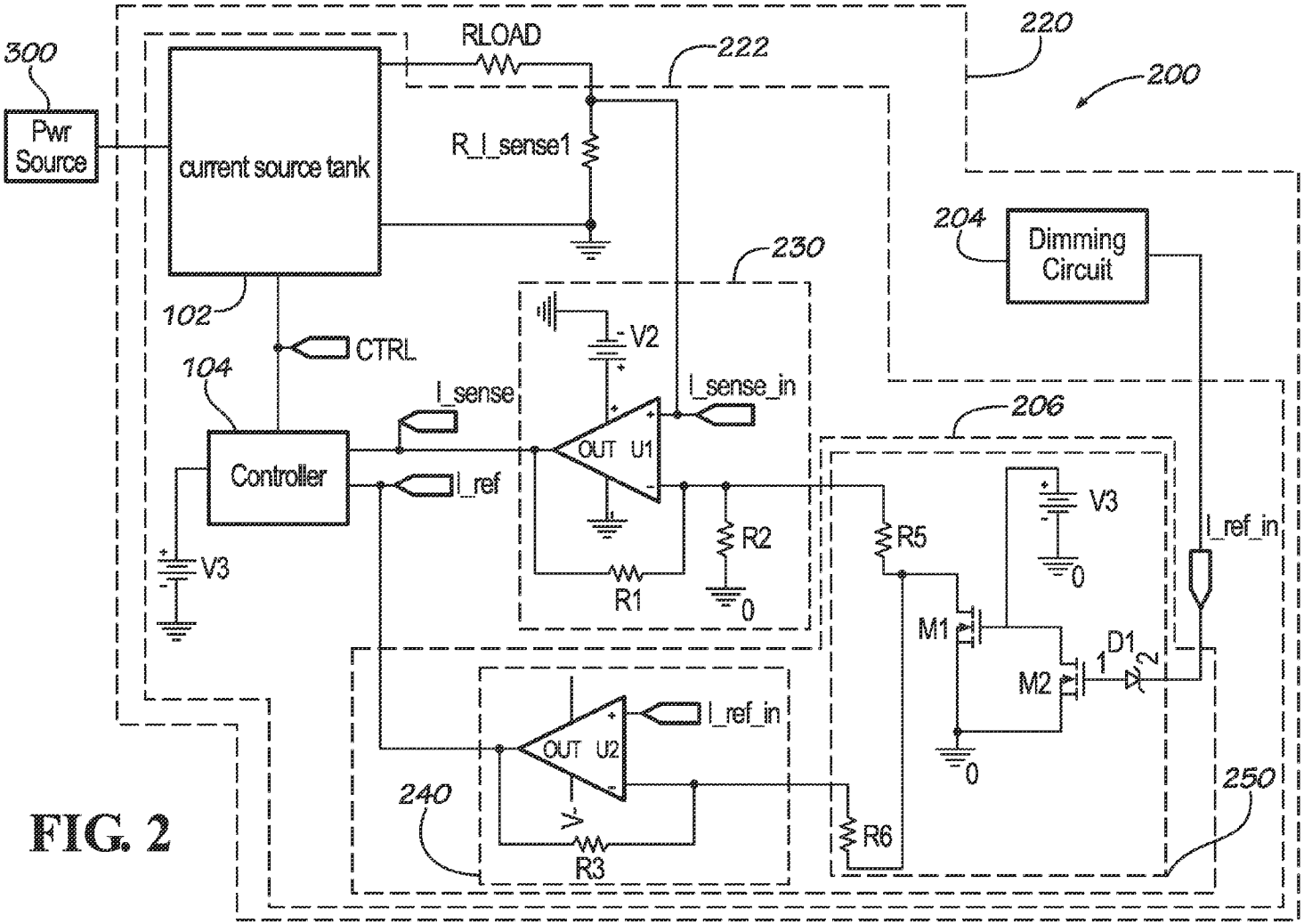
FIG. 2 is partial schematic diagram of a light fixture including a constant current driver circuit with a gain control circuit in accordance with an embodiment of the present invention.

Referring to FIG. 2, a reference current amplifier (e.g., second operational amplifier U2) modifies a reference current voltage at a reference current input of the controller 104. A fifth resistor R5 is connected in series with a first switch M1 to adjust the gain of the reference current amplifier U2 when the reference current signal I_ref_in is below a threshold. A sixth resistor R6 is connected between the first switch M1 and the inverting input of the current sensing amplifier U1 to control the gain of the current sensing amplifier U1 (i.e., to increase the gain of the current sensing amplifier when the reference current signal I_ref_in is below the threshold).

When the first switch M1 is open, the gain of the current sensing amplifier U1 is the same as shown in Equation 1, and the gain of the reference current amplifier U2 is approximately 1 (i.e., unity).

When the first switch M1 is enabled, the first switch M1 is approximately a short circuit such that the fifth resistor R5 and the sixth resistor R6 are effectively connected to ground. The gain of the current sensing amplifier U1 is shown in Equation 4 and the gain of the reference current amplifier U2 is shown in Equation 5 when the first switch M1 is enabled (i.e., when the reference current signal I_ref_in is below the threshold).

$$I_{sense} = \frac{R1 + \frac{R2 \cdot R5}{R2 + R5}}{\frac{R2 \cdot R5}{R2 + R5}} \cdot I_{sense_in} \qquad \text{EQUATION 4}$$

$$I_{ref} = \frac{R3 + R6}{R6} \cdot I_{ref_in} \qquad \text{EQUATION 5}$$

The controller 104 adjusts the control signal to make the voltage at the current sensing input of the controller 104 equal to the reference current input of the controller 104. Thus, when the first switch M1 is enabled, the relationship between the reference current signal I_ref_in and current sense signal across I_sense_in is defined by Equation 6.

$$\frac{I_{ref_input}}{I_{sense_in}} = \frac{R1 + \frac{R2 \cdot R5}{R2 + R5}}{\frac{\frac{R2 \cdot R5}{R2 + R5}}{\frac{R3 + R6}{R6}}} \quad \text{EQUATION 6}$$

Thus, the gain of the current sensing amplifier U1 increases according to Equation 4 when the first switch M1 is enabled, and the gain of the reference current amplifier U2 increases according to Equation 5.

The first switch M1 is controlled by a second switch M2. The second switch M2 is controlled by a zener diode D1 receiving the reference current input signal I_ref_in. When the reference current signal I_ref_in is less than the sum of the threshold voltage of the second switch M2 and the clamping voltage of the zener diode D1, the second switch M2 will be turned off and the first switch M1 will be turned on. When the reference current signal I_ref_in is not less than the sum of the threshold voltage of the second switch M2 and the clamping voltage of the zener diode D1, the second switch M2 will be turned on and the first switch M1 will be turned off. Thus, when the reference current signal I_ref_in decreases, the output current of the current source tank 102 will decrease, and when the reference current signal I_ref_in decreases to a certain point, the first switch M1 will be enabled to increase the gain of current sensing amplifier U1 and the reference current amplifier U2.

Forcing Equation 6 to be equal to Equation 3, current control by the controller 104 will be the same as in the prior art, but the current feedback signal (i.e., voltage at the current sensing input of the controller 104) will be much higher than what is shown in the prior art controlling Equation 3.

$$\frac{I_{ref_in}}{I_{sense_in}} = \frac{R1 + R2}{R2} = \frac{R1 + \frac{R2 \cdot R5}{R2 + R5}}{\frac{\frac{R2 \cdot R5}{R2 + R5}}{\frac{R3 + R6}{R6}}} \quad \text{EQUATION 7}$$

Equation 7 shows the design target of the gain relationship under the two gain scenarios described above. If Equation 7 is satisfied, a control program or scheme of the controller 104 does not need to be changed from prior art control programs to maintain the output current level control when the sensed reference current and sensed output current received at the controller 104 is changed by the gain control circuit 206.

Referring to FIG. 2, in one embodiment, a light fixture 200 includes a light source R_load, a housing 220, and a constant current driver circuit 222. The light source R_load provides light in response to receiving power. The housing 220 supports the light source R_load, constant current driver circuit 222, and an optional dimming circuit 204. The dimming circuit 204 provides the reference current signal to a gain control circuit 206 of the constant current driver circuit 222 as a function of a selected dimming level or brightness level received at the light fixture 200 from a user or dimming controller.

The constant current driver circuit 222 includes the current source tank circuit 102, the controller 104, an output current sensing circuit 230, and the gain control circuit 206. The current source tank circuit 102 receives power from a power source 300 and provides an output current to the light source R_load as a function of a control signal. The current source tank circuit 102 has (e.g., defines) a circuit ground.

The controller 104 has an output current sensing input, a reference current input, and a control signal output. The control signal output provides the control signal to the current source tank circuit 102. The controller 104 is configured (e.g., programmed) to adjust the control signal as a function of a sensed output current I_sense received at the output current sensing input and a sensed reference current I_ref received at the reference current input of the controller 104.

The output current sensing circuit 230 senses the output current provided by the current source tank circuit 102 to the light source R_load and provides an amplified current sensing signal I_sense to the output current sensing input of the controller 104. In one embodiment, the output current sensing circuit 230 includes a current sensing resistor R_I_sense, a current sensing amplifier U1, a first resistor R1, and a second resistor R2. The current sensing resistor R_I_sense has a first terminal connected to the light source R_load and a second terminal connected to the circuit ground. The current sensing amplifier U1 has an inverting input, a non-inverting input, and an output. The output of the current sensing amplifier U1 is connected to the output current sensing input of the controller 104. The first resistor R1 is connected between the inverting input of the current sensing amplifier U1 and the output of the current sensing amplifier U1. The second resistor R2 is connected between the inverting input of the current sensing amplifier U1 and the circuit ground.

The gain control circuit 206 receives the reference current signal I_ref_in, adjusts a gain of the output current sensing circuit 230 as a function of the received reference current signal I_ref_in, and provides a modified reference current signal I_ref to the reference current input of the controller 104 as a function of the received reference current signal I_ref_in. In one embodiment, the gain control circuit 206 includes a reference current modification circuit 240. The reference current modification circuit 240 receives the reference current signal I_ref_in, modifies the reference current signal as a function of the received reference current signal, and provides the modified reference current signal I_ref to the reference current input of the controller 104. In one embodiment, the reference current modification circuit 240 modifies the reference current signal I_ref_in only when the reference current signal is below the threshold described above such that the first switch M1 is enabled. In one embodiment, the reference current modification circuit 240 includes a reference current amplifier U2 and a third resistor R3. The reference current amplifier U2 has an inverting input, a non-inverting input, and an output. The gain of the reference current amplifier U2 is approximately 1 when the reference current signal I_ref_in is not below the threshold. The gain of the reference current amplifier is greater than 1 when the reference current signal I_ref_in is below the threshold (i.e., when the first switch M1 is enabled). The third resistor R3 connects the inverting input to the output of the reference current amplifier U2. The output of the reference current amplifier U2 is connected to the reference current input of the controller 104.

In one embodiment, the gain control circuit 206 further includes a threshold circuit 250. The threshold circuit 250 receives the reference current signal I_ref_in, connects the inverting input of the current sensing amplifier U1 to the circuit ground via a fifth resistor R5 when the reference current signal is below the threshold such that the gain of the current sensing amplifier U1 increases, and connects an inverting input of the reference current amplifier U1 of the reference current modification circuit 240 of the gain control circuit 206 to the circuit ground via a sixth resistor R6 when the reference current signal I_ref_in is below the threshold such that the gain of the reference current amplifier U2 increases.

In one embodiment, the threshold circuit 250 includes the first switch M1, the second switch M2, and the zener diode D1. The first switch M1 has a first terminal connected to the fifth resistor R5 and the sixth resistor R6, a second terminal connected to the circuit ground, and a control terminal connected to a bias voltage (e.g., VCC). The second switch M2 has a first terminal connected to the bias voltage, a second terminal connected to the circuit ground, and a control terminal. The zener diode D1 has a cathode configured to receive the reference current signal and an anode connected to the control terminal of the second switch M2.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, processor, computing device, client computing device or computer, such as described herein, includes at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media. As used herein, server is not intended to refer to a single computer or computing device. In implementation, a server will generally include an edge server, a plurality of data servers, a storage database (e.g., a large scale RAID array), and various networking components. It is contemplated that these devices or functions may also be implemented in virtual machines and spread across multiple physical computing devices.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful AUTOMATIC CURRENT AND REFERENCE GAIN CONTROL FOR WIDE RANGE CURRENT CONTROL it is not intended that such references be construed as limitations upon the scope of this invention except as set forth in the following claims.

What is claimed is:

1. A constant current driver circuit comprising:

a current source tank circuit configured to receive power from a power source and provide an output current to a load as a function of a control signal;

the current source tank circuit including a circuit ground;

a controller having an output current sensing input, a reference current input, and a control signal output;

the control signal output is configured to provide the control signal to the current source tank circuit;

the controller is configured to adjust the control signal as a function of a sensed output current received at the output current sensing input and a sensed reference current received at the reference current input;

an output current sensing circuit operable to sense the output current provided by the current source tank circuit to the load and provide an amplified current sensing signal to the output current sensing input of the controller;

a gain control circuit operable to receive a reference current signal, adjust a gain of the output current sensing circuit as a function of the received reference current signal, and provide a modified reference current signal to the reference current input of the controller as a function of the received reference current signal; and the output current sensing circuit comprises a current sensing resistor having a first terminal configured to connect to the load and a second terminal connected to the circuit ground, a current sensing amplifier having an inverting input, a non-inverting input, and an output connected to the output current sensing input of the controller, a first resistor connected between the inverting input of the current sensing amplifier and the output of the current sensing amplifier, and a second resistor connected between the inverting input of the current sensing amplifier and the circuit ground.

2. The constant current driver circuit of claim 1, wherein the gain control circuit comprises a reference current modification circuit operable to:

receive the reference current signal;

modify the reference current signal the reference current as a function of the reference current signal;

and provide the modified reference current signal to the reference current input of the controller.

3. The constant current driver circuit of claim 1, wherein the gain control circuit comprises a reference current modification circuit operable to:

receive the reference current signal;

modify the reference current signal when the reference current signal is below a threshold;

and provide the modified reference current signal to the reference current input of the controller.

4. A constant current driver circuit comprising:

a current source tank circuit configured to receive power from a power source and provide an output current to a load as a function of a control signal;

the current source tank circuit including a circuit ground;

a controller having an output current sensing input, a reference current input, and a control signal output;

the control signal output is configured to provide the control signal to the current source tank circuit;

the controller is configured to adjust the control signal as a function of a sensed output current received at the output current sensing input and a sensed reference current received at the reference current input;

an output current sensing circuit operable to sense the output current provided by the current source tank circuit to the load and provide an amplified current sensing signal to the output current sensing input of the controller;

a gain control circuit operable to receive a reference current signal, adjust a gain of the output current sensing circuit as a function of the received reference current signal, and provide a modified reference current signal to the reference current input of the controller as a function of the received reference current signal;

the gain control circuit comprises a reference current modification circuit operable to receive the reference current signal, modify the reference current signal as a function of the received reference current signal, and provide the modified reference current signal to the reference current input of the controller;

the reference current modification circuit comprising a reference current amplifier having an inverting input, a non-inverting input, and an output, a gain of the reference current amplifier is approximately 1 when the reference current signal is not below a threshold, and the gain of the reference current amplifier is greater than 1 when the reference current signal is below the threshold;

a third resistor connecting the inverting input of the reference current amplifier to the output of the reference current amplifier; and the output of the reference current amplifier is connected to the reference current input of the controller.

5. The constant current driver circuit of claim 1, wherein the gain control circuit comprises a threshold circuit operable to:

receive the reference current signal;

connect the inverting input of the current sensing amplifier to the circuit ground via a fifth resistor when the reference current signal is below a threshold such that the gain of the current sensing amplifier increases; and connect an inverting input of a reference current amplifier of a reference current modification circuit of the gain control circuit to the circuit ground via a sixth resistor when the reference current signal is below the threshold such that a gain of the current sensing amplifier increases.

6. The constant current driver circuit of claim 1 further comprising:

the gain control circuit comprises a threshold circuit operable to receive the reference current signal, connect the inverting input of the current sensing amplifier to the circuit ground via a fifth resistor when the reference current signal is below a threshold such that a gain of the current sensing amplifier increases, and connect an inverting input of a reference current amplifier of a reference current modification circuit of the gain control circuit to the circuit ground via a sixth resistor when the reference current signal is below the threshold such that a gain of the reference current amplifier increases; and the threshold circuit comprises a first switch having a first terminal connected to the fifth resistor and the sixth resistor, a second terminal connected to the circuit ground, and a control terminal connected to a bias voltage, a second switch having a first terminal connected to the bias voltage, a second terminal connected to the circuit ground, and a control terminal, and a zener diode having a cathode configured to receive the reference current signal and an anode connected to the control terminal of the second switch.

7. A light fixture comprising:

a light source operable to provide light in response to receiving power;

a constant current driver circuit configured to provide power to the light source, said constant current driver circuit comprising a current source tank circuit operable to receive power from a power source and provide an output current to the light source as a function of a control signal, wherein the current source tank circuit has a circuit ground, a controller having an output current sensing input, a reference current input, and a control signal output, wherein the control signal output provides the control signal to the current source tank circuit and the controller is operable to adjust the control signal as a function of a sensed output current received at the output current sensing input and a sensed reference current received at the reference current input, an output current sensing circuit operable to sense the output current provided by the current source tank circuit to the light source and provide an amplified current sensing signal to the output current sensing input of the controller, and a gain control circuit operable to receive a reference current signal, adjust a gain of the output current sensing circuit as a function of the received reference current signal, and provide a modified reference current signal to the reference current input of the controller as a function of the received reference current signal;

a housing configured to support the light source and the constant current driver circuit; and a dimming circuit operable to provide the current reference signal as a function of a selected dimming level.

8. The light fixture of claim 7, wherein the gain control circuit of the constant current driver circuit comprises a reference current modification circuit operable to:

receive the reference current signal, modify the reference current signal as a function of the received reference current signal, and provide the modified reference current signal to the reference current input of the controller.

9. The light fixture of claim 7, wherein the gain control circuit of the constant current driver circuit comprises a reference current modification circuit operable to:

receive the reference current signal, modify the reference current signal when the reference current signal is below a threshold, and provide the modified reference current signal to the reference current input of the controller.

10. The light fixture of claim 7, further comprising:

the gain control circuit of the constant current driver circuit comprises a reference current modification circuit operable to receive the reference current signal, modify the reference current signal as a function of the received reference current signal, and provide the modified reference current signal to the reference current input of the controller, the reference current modification circuit comprises a reference current amplifier having an inverting input, a non-inverting input, and an output, a gain of the reference current amplifier is approximately 1 when the reference current signal is not below a threshold, and the gain of the reference current amplifier is greater than 1 when the reference current signal is below the threshold, a third resistor connecting the inverting input to the output, and the output is connected to the reference current input of the controller.

11. The light fixture of claim 7, wherein the output current sensing circuit of the constant current driver circuit comprises:

a current sensing resistor having a first terminal operable to connected to the light source and a second terminal connected to the circuit ground;

a current sensing amplifier having an inverting input, a non-inverting input, and an output, wherein the output is connected to the output current sensing input of the controller;

a first resistor connected between the inverting input of the current sensing amplifier and the output of the current sensing amplifier; and a second resistor connected between the inverting input of the current sensing amplifier and the circuit ground.

12. The light fixture of claim 11, wherein the gain control circuit of the constant current driver circuit comprises a threshold circuit operable to:

receive the reference current signal;

connect the inverting input of the current sensing amplifier to the circuit ground via a fifth resistor when the reference current signal is below a threshold such that a gain of the current sensing amplifier increases; and connect an inverting input of a reference current amplifier of a reference current modification circuit of the gain control circuit to the circuit ground via a sixth resistor when the reference current signal is below the threshold such that a gain of the current sensing amplifier increases.

13. The light fixture of claim 11, further comprising:

the gain control circuit of the constant current driver circuit comprises a threshold circuit operable to receive the reference current signal, connect the inverting input of the current sensing amplifier to the circuit ground via a fifth resistor when the reference current signal is below a threshold such that a gain of the current sensing amplifier increases, and connect an inverting input of a reference current amplifier of a reference current modification circuit of the gain control circuit to the circuit ground via a sixth resistor when the reference current signal is below the threshold such that a gain of the reference current amplifier increases; and the threshold circuit comprises a first switch having a first terminal connected to the fifth resistor and the sixth resistor, a second terminal connected to the circuit ground, and a control terminal connected to a bias voltage, a second switch having a first terminal connected to the bias voltage, a second terminal connected to the circuit ground, and a control terminal, and a zener diode having a cathode configured to receive the reference current signal and an anode connected to the control terminal of the second switch.

* * * * *